US009239189B2

(12) United States Patent
Martella

(10) Patent No.: US 9,239,189 B2
(45) Date of Patent: Jan. 19, 2016

(54) KILN

(75) Inventor: Charlie Martella, Bunbury (AU)

(73) Assignee: ANSAC Pty Ltd, Bunbury (AU)

( * ) Notice: Subject to any disclaimer, the term of this patent is extended or adjusted under 35 U.S.C. 154(b) by 1386 days.

(21) Appl. No.: 12/741,439

(22) PCT Filed: Nov. 4, 2008

(86) PCT No.: PCT/AU2008/001634

§ 371 (c)(1),
(2), (4) Date: Aug. 13, 2010

(87) PCT Pub. No.: WO2009/059356

PCT Pub. Date: May 14, 2009

(65) Prior Publication Data

US 2010/0304320 A1 Dec. 2, 2010

(30) Foreign Application Priority Data

Nov. 5, 2007 (AU) ..... 2007906057
Mar. 14, 2008 (AU) ..... 2008901280

(51) Int. Cl.

| | |
|---|---|
| ***F27B 7/36*** | (2006.01) |
| ***F27B 7/00*** | (2006.01) |
| ***F27B 7/10*** | (2006.01) |
| ***F27B 7/20*** | (2006.01) |
| ***F27B 7/16*** | (2006.01) |

(52) U.S. Cl.
CPC . *F27B 7/00* (2013.01); *F27B 7/161* (2013.01); *F27B 7/20* (2013.01); *F27B 7/36* (2013.01)

(58) Field of Classification Search
None
See application file for complete search history.

(56) References Cited

U.S. PATENT DOCUMENTS

| | | | | |
|---|---|---|---|---|
| 2,288,028 | A * | 6/1942 | Richardson | 126/99 R |
| 2,469,562 | A * | 5/1949 | Kennedy | 432/61 |
| 2,602,782 | A * | 7/1952 | Zoradi | 432/13 |
| 3,207,135 | A * | 9/1965 | Durham | 122/510 |
| 3,503,736 | A * | 3/1970 | Sherwood | C21B 13/085 75/476 |

(Continued)

FOREIGN PATENT DOCUMENTS

| | | | |
|---|---|---|---|
| SU | 560112 | A | 7/1977 |
| SU | 1006898 | A | 3/1983 |

OTHER PUBLICATIONS

PCT International Search Report for PCT/AU/2008/001634, Dec. 23, 2008, 4 pages.

(Continued)

*Primary Examiner* — Gregory Huson
*Assistant Examiner* — Eric Gorman
(74) *Attorney, Agent, or Firm* — Reising Ethington P.C.

(57) ABSTRACT

A kiln comprising a cylindrical drum (11) arranged to rotate about a generally horizontal central axis, the drum configured such that rotation will cause particulate material to flow from one end (13) of the drum to the other end (15). The one end being closed by an end assembly (23) fixed relative to a support structure. An inner face of the drum provides a plurality of ports (29) spaced about, and opening into, an interior of the drum,. The ports (29) being connected to the end assembly (23) via a set of passageways (27). The end assembly (23) having an opening (25) connected to a source of air (31) and positioned such that, on rotation of the drum, one or more passageways come into fluid communication with the opening for limiting air flow to the ports.

22 Claims, 6 Drawing Sheets

Legend:

| | |
|---|---|
| 11 – drum | 33 – hopper |
| 16 – refractory | 37 – outlet chamber |
| 17 – rollers | 39 – lower outlet |
| 19 – plenum | 41 – upper outlet |
| 23 – end plate | 43 – burner |

(56) References Cited

U.S. PATENT DOCUMENTS 3,599,947 A * 8/1971 Sherwood ..... C21B 13/085 266/163
3,749,033 A * 7/1973 Sugano et al. ..... 110/234
3,802,679 A * 4/1974 Schroeder ..... 266/138
3,819,323 A * 6/1974 Hemsath et al. ..... 432/138
3,915,627 A * 10/1975 Foy ..... 432/105
3,916,806 A * 11/1975 Giraud ..... 110/203
3,918,891 A * 11/1975 Theil ..... 432/18
4,021,195 A * 5/1977 Sylvest ..... 432/80
4,059,396 A * 11/1977 Dano ..... 432/78
4,136,965 A * 1/1979 Sunnergren et al. ..... 366/25
4,155,704 A * 5/1979 Kulabukhov et al. ..... 432/105
4,207,062 A * 6/1980 Moench ..... E01C 19/1036 366/25
4,266,931 A * 5/1981 Struckmann ..... 432/105
4,315,720 A * 2/1982 Ueda et al. ..... 425/8
4,323,523 A * 4/1982 Ueda et al. ..... 264/8
4,507,080 A * 3/1985 Freze ..... 432/105
4,518,350 A * 5/1985 Mueller ..... F27B 7/162 209/11
4,576,572 A * 3/1986 Mueller ..... F27B 7/162 432/105
4,632,042 A * 12/1986 Chang ..... F23G 5/32 110/165 R
4,712,491 A * 12/1987 Schmidt ..... F23B 1/36 110/248
4,782,768 A * 11/1988 Lee et al. ..... 110/246
4,793,269 A * 12/1988 Dezubay et al. ..... 110/246
5,018,968 A * 5/1991 Barreto ..... F27B 7/383 110/226
5,100,314 A * 3/1992 Rierson ..... 432/103
5,119,395 A * 6/1992 Hemsath et al. ..... 373/112
5,230,617 A * 7/1993 Klein ..... F27D 9/00 110/180
5,297,957 A * 3/1994 Brashears ..... 432/14
5,579,334 A * 11/1996 Baxter et al. ..... 373/109
5,628,629 A * 5/1997 Mitani et al. ..... 432/180
5,702,247 A * 12/1997 Schoof ..... 432/103
6,027,333 A * 2/2000 Fujii et al. ..... 431/215
6,183,242 B1 * 2/2001 Heian ..... 432/11
6,309,211 B1 * 10/2001 Dock et al. ..... 432/119
6,568,653 B1 * 5/2003 Foresman ..... 251/78

OTHER PUBLICATIONS

PCT Written Opinion for PCT/AU/2008/001634, Dec. 23, 2008, 7 pages.

Written Opinion for PCT/AU/2008/001634, Dec. 23, 2008, 7 pages.

* cited by examiner

Legend:

| | |
|---|---|
| 11 – drum | 33 – hopper |
| 16 – refractory | 37 – outlet chamber |
| 17 – rollers | 39 – lower outlet |
| 19 – plenum | 41 – upper outlet |
| 23 – end plate | 43 – burner |

Legend:
- 11 – drum
- 19 – plenum
- 21 – link member
- 23 – end plate
- 31 – inlet

KILN

FIELD OF THE INVENTION

This invention relates to combustion kilns. The particular application of the invention relates to a combustion kiln which can be utilized for the combustion of materials for the generation of heat energy.

BACKGROUND ART

The following discussion of the background art is intended to facilitate an understanding of the present invention only. The discussion is not an acknowledgement or admission that any of the material referred to is or was part of the common general knowledge as at the priority date of the application.

A particular application of the combustion kiln according to the invention relates to one which can be utilized for the combustion of waste materials for the production of heat energy and which may, if desired, be used for the generation of electricity. In recent times it has been realised that potential fuels which can be utilized for the generation of heat can include bio-waste materials such as manures which have previously been considered as waste materials which have had little commercial value. Examples of such waste products comprise refuse, chicken manure and the like. A difficulty which has been faced in the past is the safe and efficient burning of such materials with the minimum of pollution resulting from such combustion.

DISCLOSURE OF THE INVENTION

Throughout the specification and claim unless the context requires otherwise, the word "comprise" or variations such as "comprises" or "comprising", will be understood to imply the inclusion of a stated integer or group of integers but not the exclusion of any other integer or group of integers.

According to one aspect the invention resides in a combustion kiln comprising a substantially cylindrical drum supported from a support structure for rotation about its central axis whereby the drum is supported such that the central axis is generally horizontal, the internal face of the wall of the drum being lined with a refractory material, whereby the drum is configured and/or arranged such that rotation of the drum will cause fluid particulate material to flow from one end to other, said one end being associated with an inlet arranged and configured to enable the particulate material to be delivered into the inlet, wherein the particulate material comprises at least in part material which capable of combustion, the other end being provided with a discharge for combustion products and heat, the inner face of the side wall of the drum being provided with a plurality of ports which are located at spaced intervals along and around the interior of the drum and which open into the interior of the drum, the one end being closed by an end plate fixed relative to the support structure to sealingly overlie the one end, an opening provided in the end assembly, the opening connected to a source of air, a set of passageways provided at angularly displaced positions around the kiln, said passageways extending substantially axially from the one end and being accommodated at least partially in the refractory material, said passageways communicating with the ports, the passageways each having an inlet opening at the face defining the one end, the opening being positioned such that on rotation of the drum the inlets of the passageways rotate past the opening, the opening being positioned such that the inlets communicate with the opening in the lower portion of their rotation path.

According to a preferred feature of the invention the opening is associated with a plenum chamber which overlies the opening, the plenum chamber being connected to the source of air, According to another aspect the invention resides in a combustion kiln comprising a substantially cylindrical drum supported from a support structure for rotation about its central axis the internal face of the wall of the drum being lined with a refractory material, whereby the drum is supported such that the central axis is generally horizontal and whereby the drum is configured and/or arranged such that rotation of the drum will cause fluid particulate material to flow from one end to other, said one end being associated with an inlet arranged and configured to enable the particulate material to be delivered into the inlet, the particulate material comprises at least in part material which is capable of combustion, the other end being provided with a discharge for combustion products and heat, the inner face of the side walls of the drum being provided with a plurality of ports which are located at spaced intervals along and around the interior of the drum, a set of passageways extending through refractory material from the one end and providing fluid communication between the one end and the ports, an air inlet at the one end and arranged and configured to communicate. with the passageways on rotation of the drum when said ports are in the lower portion of their rotation path.

According to a preferred feature of the invention the one end is closed by an end assembly fixed relative to the support structure whereby the end assembly is maintained in close abutting end to end relationship with the one end, the air inlet comprising an opening provided in the end assembly and a plenum chamber which is intended in use to be connected to a source of air, the plenum chamber overlying the opening, the opening being positioned such that on rotation of the drum the ends of the passageways at the one end rotate past the opening.

According to a preferred feature of the invention the end assembly comprises an end pate which overlies the one end and the opening is provided through the plate.

According to a preferred feature of the invention the opening is part annular, is concentric with the drum and lies in the rotation path of the ends of the passageways at the one end.

According to a preferred feature of the invention said passageways are spaced substantially equi-angularly around the drum.

According to a preferred feature of the invention the wall of the kiln is defined by an outer shell and the refractory material is located on the inner face of the shell.

According to a preferred feature of the invention the passageways are defined by channels located in the outer face of the refractory lining and wherein the channels are closed by the outer shell.

According to a preferred feature of the invention the passageways are formed within the refractory material between the inner and outer face thereof.

According to a preferred feature of the invention each passageway communicates with a plurality of ports located at spaced intervals along the drum.

According to a preferred feature of the invention, the kiln further comprises a burner located in the region of the one end, the burner directed towards the interior face at the lower portion of the rotation path of the wall. According to a preferred feature of the invention the outlet of the burner is located such that it is directed onto the portion of the interior face as it rotates from the lowermost portion of the lower portion of the rotation path.

According to a preferred feature of the invention the interior of the drum is isolated from the exterior.

According to a preferred feature of the invention the interior face of the wall is formed with inwardly projecting protrusions. According to a preferred feature of the invention the protrusions comprise a set of rib like formations. According to a preferred feature of the invention the rib-like protrusions have a helical configuration. According to a preferred feature of the invention the passageways are substantially parallel with the central axis of the drum. According to a preferred feature of the invention the passageways are configured to axially conform with the axial configuration of the rib-like protrusions. According to a preferred feature of the invention the passageways are generally located in one to one relationship with the rib-like protrusions. According to a preferred feature of the invention the ports open into the interior of the drum at the trailing face of the protrusions. According to a preferred feature of the invention the ports open into the inner face in the region of the base of the trailing edge of the protrusions.

The invention will be more fully understood in the light of the following description of several specific embodiments

BRIEF DESCRIPTION OF THE DRAWINGS

The description is made with reference to the accompanying drawings of which.

DETAILED DESCRIPTION OF SPECIFIC EMBODIMENTS

The embodiment comprises a combustion kiln having a rotating drum 11 which is cylindrical and is supported such that it is rotatable about its central axis and whereby the support for the drum is such that the central axis is substantially horizontal but with some degree of inclination in order that with rotation of the drum and on entry of particulate material into one end 13, the material will flow towards the other end 15. The drum is supported upon suitable rollers shown schematically at 17 and is driven by a suitable rotary drive. In addition the drum and is fixed axially in the region of an end of the drum to enable expansion and contraction due to thermal expansion and contraction from that end.

Figure 1:
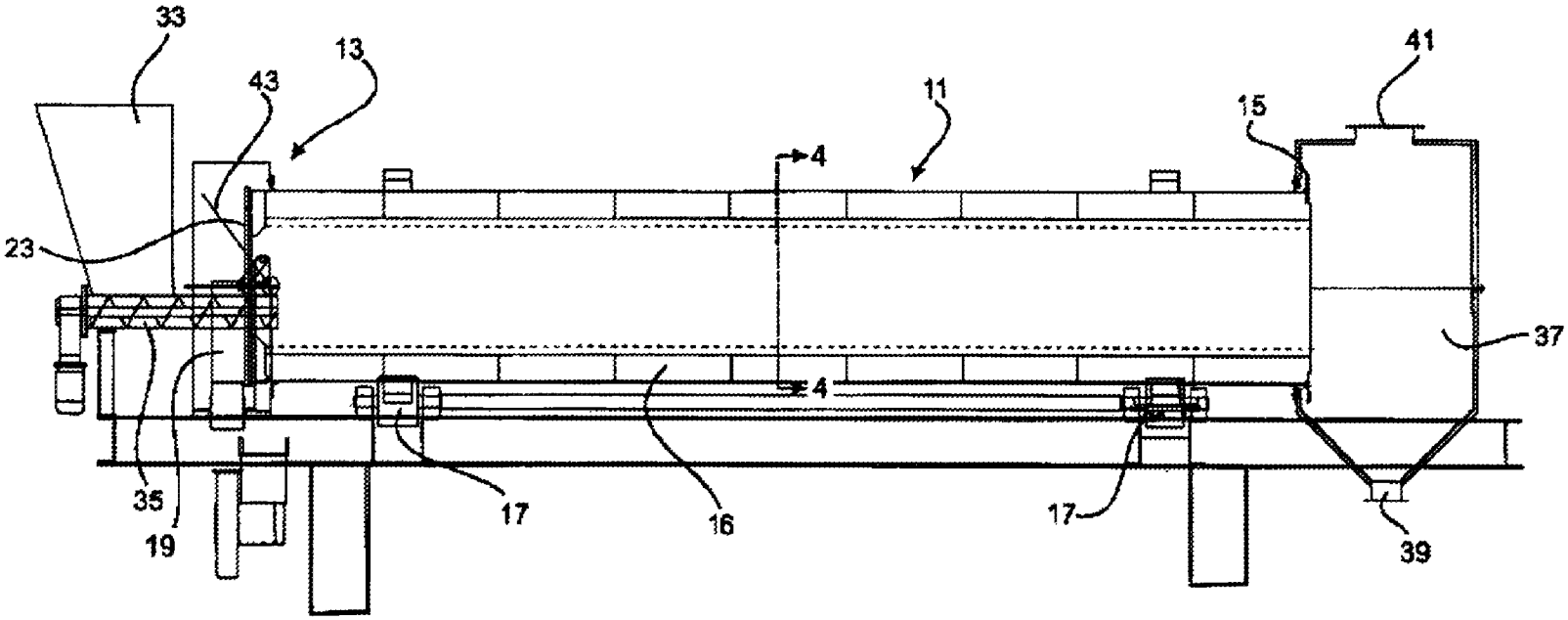
FIG. 1 is a schematic side elevation of a combustion kiln according to the first embodiment.
Figure 2:
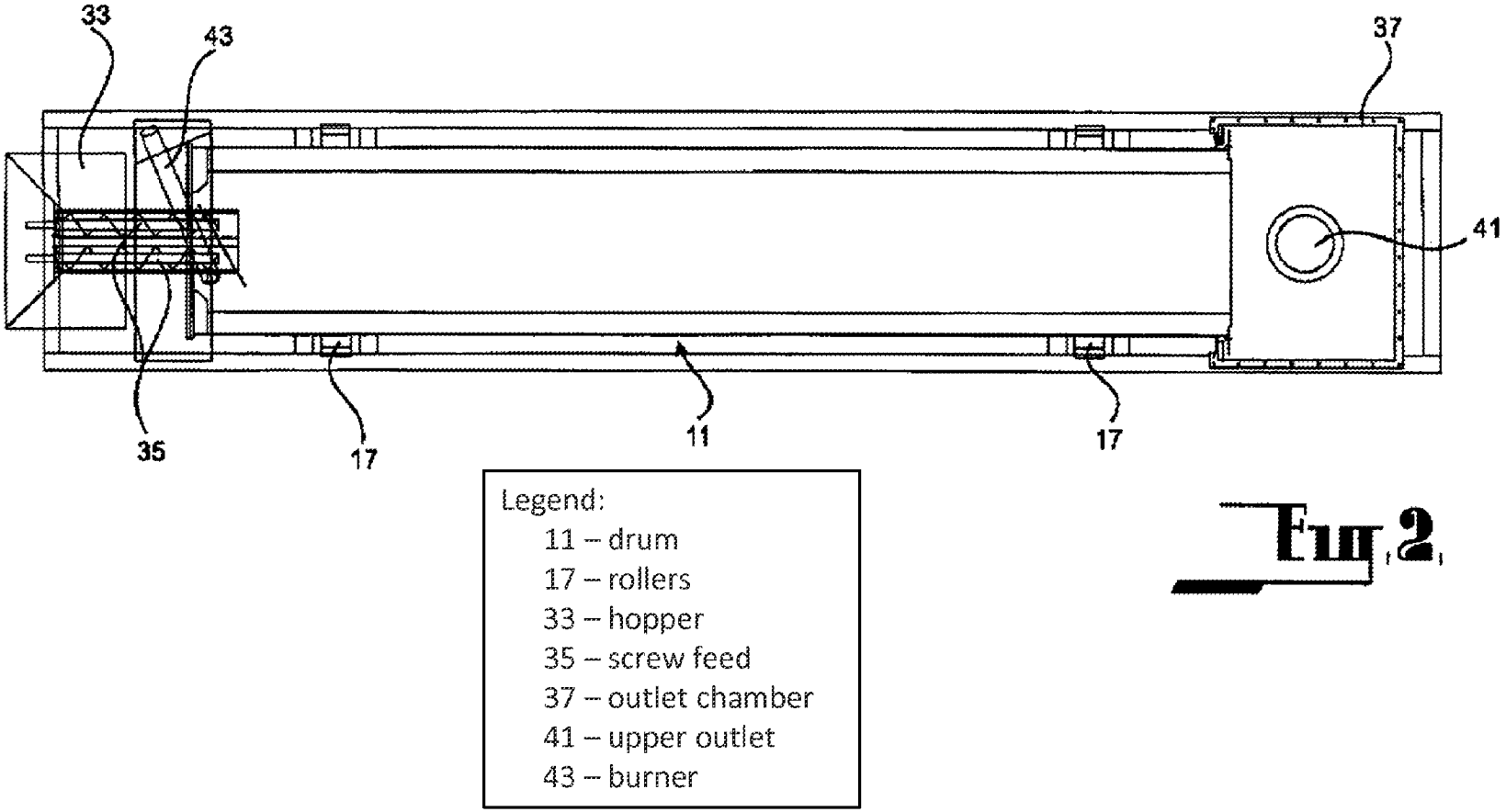
FIG. 2 is a plan view of a combustion kiln according to the first embodiment.
Figure 3:
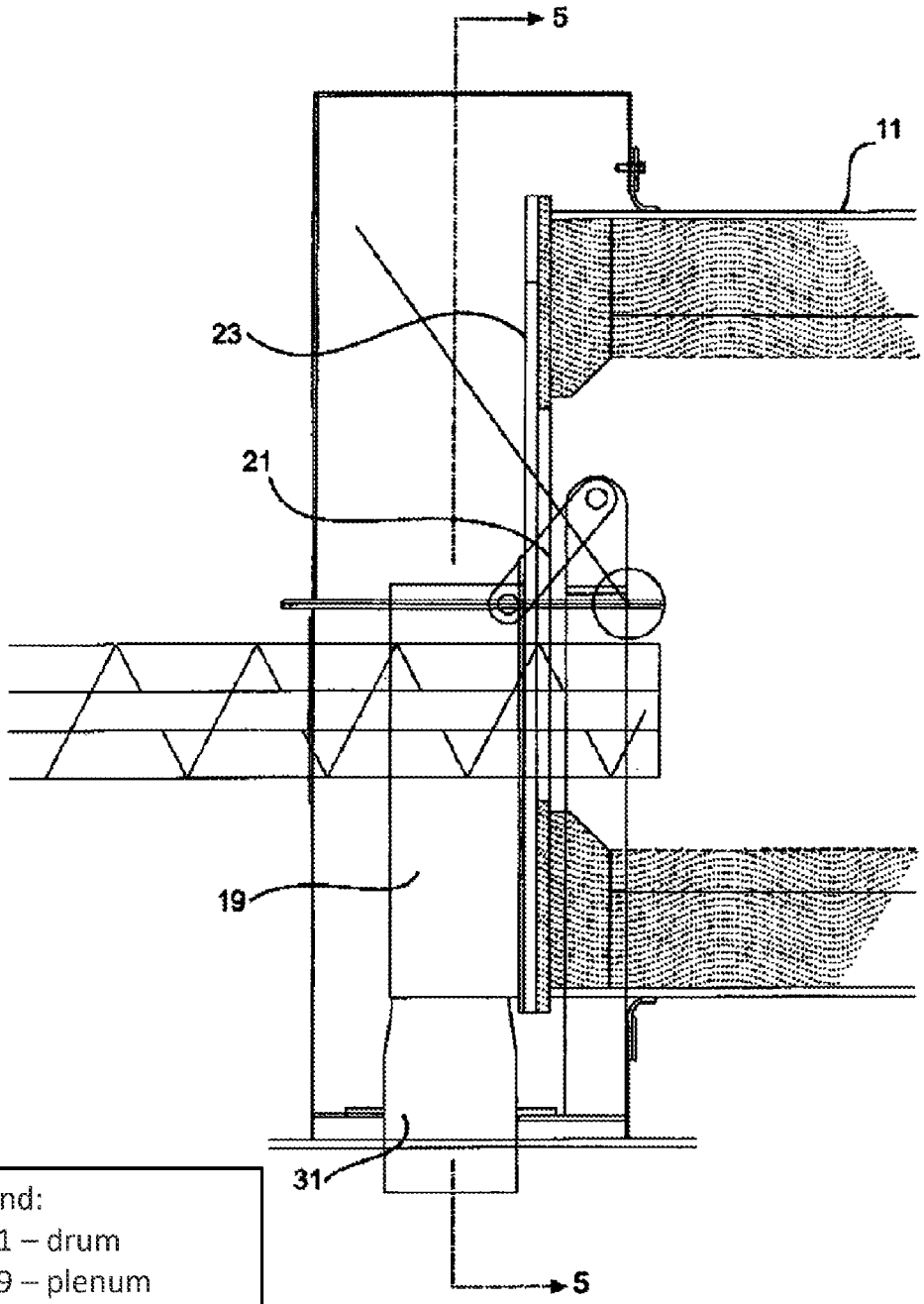
FIG. 3 is an enlarged side elevation of the one end of the drum and the associated plenum chamber and fuel inlet according to the first embodiment.
Figure 4:
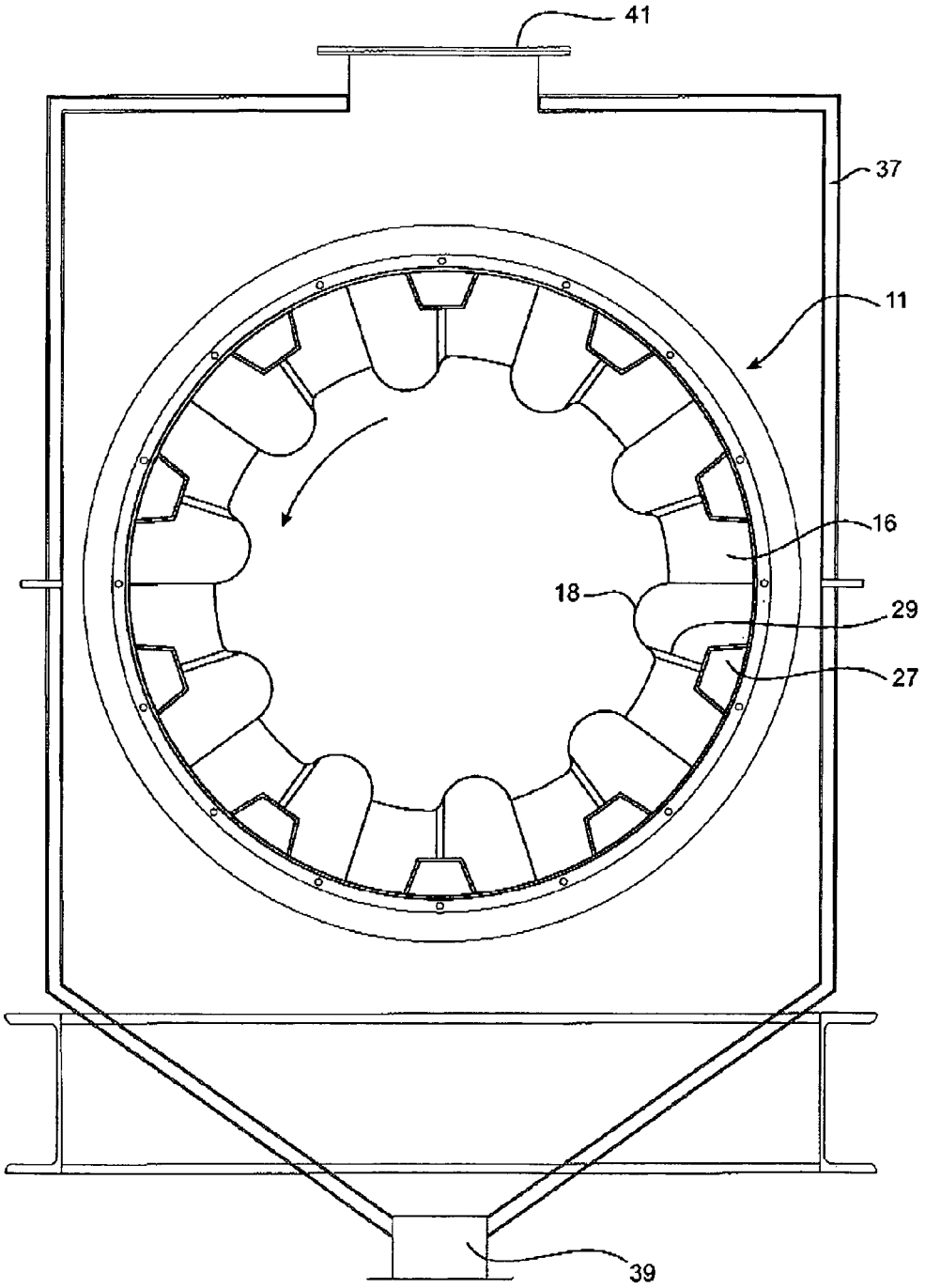
FIG. 4 is a sectional view along line 4-4 of FIG. 1.
Figure 5:
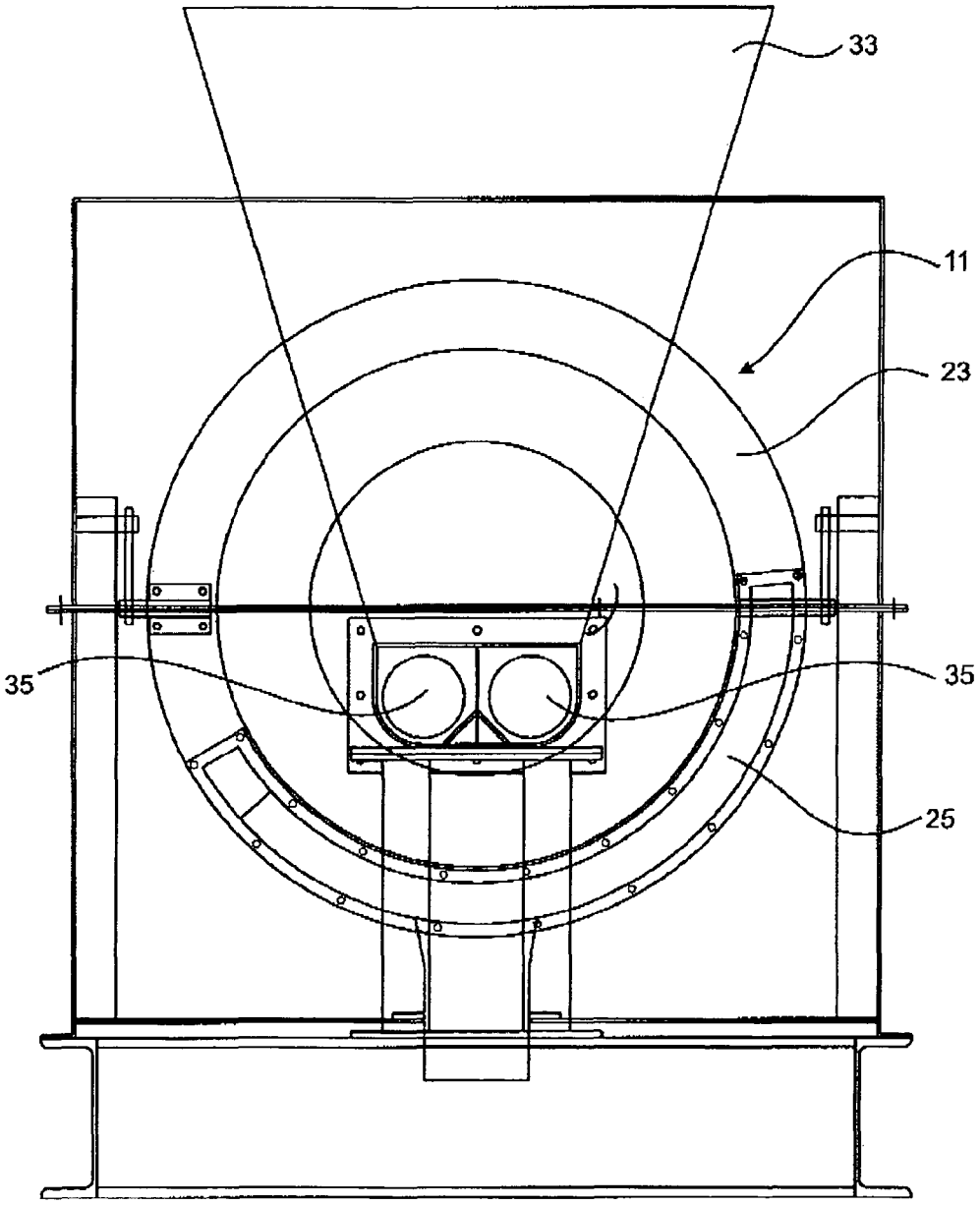
FIG. 5 is a sectional view along line 5-5 of FIG. 3.

The interior of the drum is lined with refractory 16 which, as shown in FIG. 4, is formed with a set of generally axial ribs 18 which extend along the length.

One end 13 of the drum is closed by an end assembly which comprises an end plate 23 and a plenum chamber 19 which overlies the end plate 23. The end plate is received over the end face of the one end 13 and serves to close the end face. The end plate 23 and is formed with a part annular slotted opening 25 which is concentric with the drum and is positioned to overlie the lower portion of the rotation path of the refractory wall of the drum. The plenum chamber 19 overlies the opening 25. The plenum chamber is connected to a forced air supply through an inlet 31. The end assembly is supported from the support structure for the kiln by a pair of pivotal links located one to each side of the drum. The pivotal links each, comprise a link member 21 which is pivotally connected at one end to the end plate and the other end to the support such that the end assembly is gravitationally biased into face to face engagement with the end face but is able to move axially as a result of the expansion and contraction of the drum and any eccentricity of the drum whilst maintaining face to face engagement with the end face of the drum.

The refractory wall 16 of the drum is formed with a set of axial passageways 27 which extend for the length of the drum and which are substantially equi-angularly spaced around the drum. The passageways 27 are formed by channels which are formed in the outer face of the refractory and the channels are closed at their outer face by the outer shell of the drum. Each of the passageways is associated with a set of radial ports 29 which are located at spaced intervals along the wall. The ports 29 each extend between the interior face of the refractory wall 16 and the respective passageway. The ports open into the inner face of the refractory wall near the trailing face of the ribs 18. The location of the opening of the ports at the trailing face of the ribs serves to prevent blockage of the ports as well as entering the material within the drum whilst it is being influenced by the rib.

The passageways 27 each open into the end face of the one end of the drum and on rotation of the drum they will each pass over the slotted opening in the end plate to provide communication between the respective set of ports and the plenum chamber. Therefore there is only communication between the radial ports and the plenum chamber and the source of pressurized air when the passageways 27 are in the lowermost portion of their rotation path.

The one end is further associated with an inlet hopper 33 into which particulate feedstock, which is to comprise the fuel of the kiln, is deposited. The hopper 33 has a screw feed 35 at the base of the inlet hopper which provides a controlled delivery of fuel into the interior of the drum 11.

The other end 15 of the drum is provided with an outlet chamber 37 which has a lower outlet 39 for the passage of ash and an upper outlet 41 for the passage of gaseous combustion products and heat form the kiln. The configuration of the outlet chamber enables the interior of the drum to be isolated from the ambient conditions to the exterior of the drum.

The kiln is further associated with a burner 43 which is located at the one end 33 and is positioned such that the flame generated by the burner is directed towards the interior wall of the drum and in particular the portion of the wall as it moves in its rotation path from the lowermost portion of the rotation path.

Figure 6:
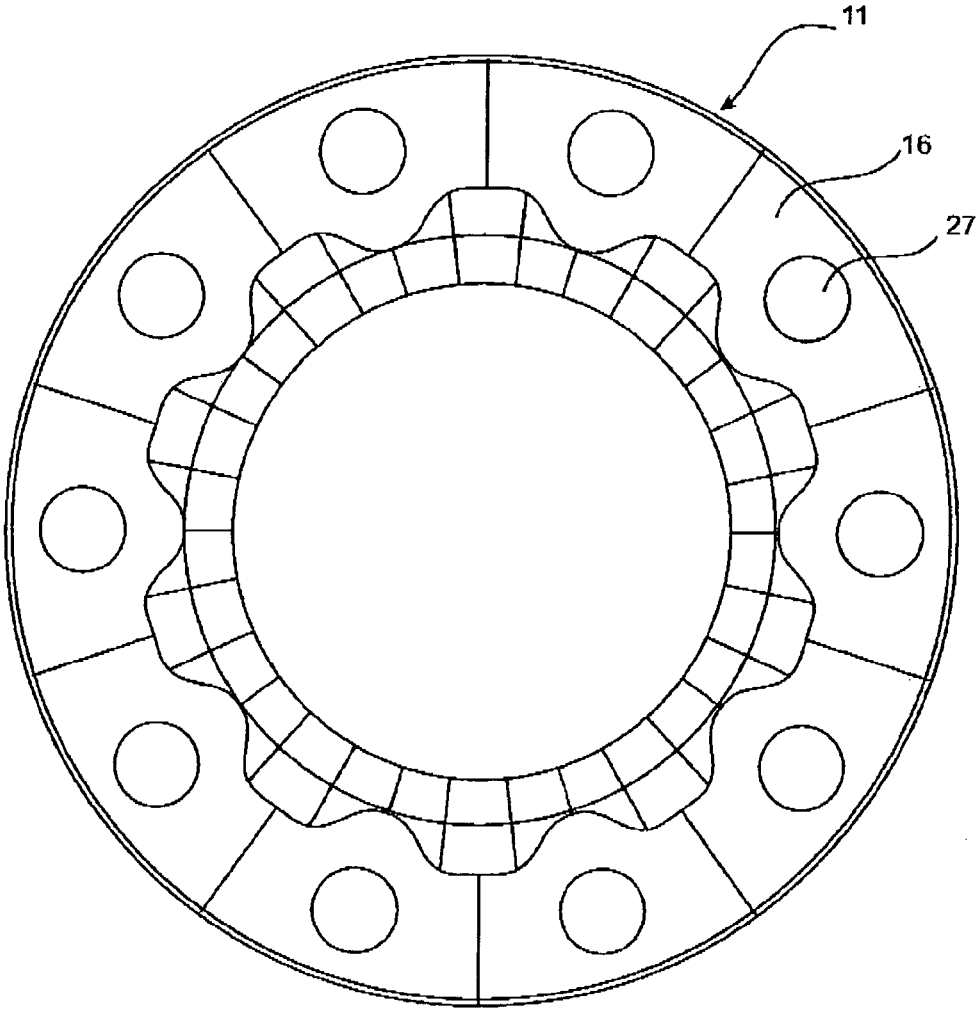
FIG. 6 is an end elevation of the drum according to the second embodiment.

In the case of the second embodiment as shown at FIG. 6 the passageways 27 are formed within the refractory lining 16 between the inner and outer face.

In the case of both embodiments it is intended that when in use, the burner will be active for as long as it takes to reach the desired ignition temperature of the feedstock which has been delivered into the kiln and once combustion of the feedstock has been established. Once the combustion has been established the burner can be shut down. The burner is associated with an appropriate sensor and control means such in order that it can be reignited if combustion ceases.

It is believed that the combustion kiln according to each of the embodiments, will be particularly efficient in its operation because of the delivery of the air into the particulate material which is resident in the lower portion of the drum. The introduction of such air serves to not only effect inter-mixing of the feedstock, but also into the mixing with air which will enhance the combustion process. In addition, the delivery of the air though the passageways which are formed in the refractory lining serves to both cool the refractory and to heat the air being delivered to the ports by the passageways for the reintroduction of such heat into the combustion chamber.

According to another embodiment the ribs can have a helical configuration to facilitate the transport of material along the length of the drum.

According to another embodiment the inlet hopper 33 is be associated with a drying means which facilitates, drying of the feedstock prior to delivery to the hopper 33 and the heat for drying the material is sourced from the heat output of the kiln.

According to another embodiment the air being delivered into the plenum chamber is heated and the heat for heating the air is sourced from the heat output of the kiln.

The present invention is not to be limited in scope by any of the specific embodiments described herein. These embodiments are intended for the purpose of exemplification only. Functionally equivalent products, materials and methods are clearly within the scope of the invention as described herein.

The claims defining the invention is as follows:

1. A kiln comprising a substantially cylindrical drum supported from a support structure, the drum arranged to be rotatable relative to the support structure about a generally horizontal central axis, the drum comprising a side wall having an inner face defining at least in part an interior of the drum, the inner face being substantially lined with a refractory material, the kiln being adapted to receive a particulate material that is at least in part combustible, the interior of the drum is arranged such that a rotation of the drum will cause fluid particulate material to flow from one end of the drum toward the other end of the drum, said one end being associated with a fuel inlet for receiving the particulate material into the drum, the kiln further comprises a plurality of ports opening into the interior of the drum, the ports being connected with the one end via a plurality of passageways that are angularly displaced about the drum and accommodated at least partially within the refractory material, each passageway having an inlet open into an end face of the one end of the drum, the kiln having an end assembly including an end plate having an opening and being fixed relative to the support structure, the one end in close abutting relationship with the end assembly such that during a rotation of the drum, the passageway inlets are moved about a rotation path and come into fluid communication with the opening in the end plate during one portion of the rotation path and are covered and blocked by the end plate during another portion of the rotation path, thereby limiting air flow to the ports for assisting a combustion process within the kiln.

2. A kiln comprising a substantially cylindrical drum supported from a support structure, the drum arranged to be rotatable about a generally horizontal central axis, the drum comprising a side wall having an inner face defining at least in part an interior of the drum, the inner face being substantially lined with a refractory material, the kiln being adapted to receive a particulate material that is at least in part combustible, the interior of the drum is arranged such that a rotation of the drum will cause fluid particulate material to flow from one end toward the other end, said one end being associated with a fuel inlet for receiving the particulate material into the drum, the kiln further comprises a plurality of ports opening into the interior of the drum, the ports being connected with the one end via a plurality of passageways that are angularly displaced about the drum and accommodated at least partially within the refractory material, each passageway having an inlet disposed at the one end, the one end being closed by an end assembly comprising a plate fixed relative to the support structure, the one end in close abutting relationship with the end assembly, the end assembly further comprising a plenum chamber and an opening, wherein the plenum chamber and the opening are in communication with an air source, wherein, during a rotation of the drum the passageway inlets are moved about a rotation path and come into fluid communication with the opening during at least a portion of the rotation path thereby limiting air flow to the ports for assisting a combustion process within the kiln, wherein, during the rotation of the drum and while at least one of the passageway inlets are in fluid communication with the air source via the plenum chamber, fluid communication of at least one of the remaining passageway inlets is obstructed by the plate of the end assembly.

3. The kiln as claimed at claim 1, wherein the opening comprises an arcuate configuration complementary to an arc in the rotation path of the passageway inlets.

4. The kiln as claimed at claim 1, wherein the opening is located in a lower portion of the rotation path of the passageway inlets.

5. A kiln comprising a substantially cylindrical drum supported from a support structure for rotation about its central axis whereby the drum is supported such that the central axis is generally horizontal, the drum comprises a side wall having an inner face defining at least in part an interior of the drum, the inner face being lined with a refractory material and configured such that a rotation of the drum will cause a particulate material within the drum to flow from one end to other, said one end being associated with a fuel inlet for receiving the particulate material into the interior and the other end being provided with a discharge for removal of combustion products and heat from the interior, the inner face comprises a plurality of ports which are located at spaced intervals along and around the interior, and a set of passageways extending between said ports and the one end for providing a fluid communication between the one end and said ports, wherein each of the set of passageways is defined by a passageway wall that is substantially circumferentially embedded within the refractory material, the one end further comprising an air inlet connected to an air source, wherein during a rotation of the drum said passageways and said ports move about a rotation path, said passageways coming into a fluidic communication with said air inlet when said ports pass through a lower portion of said rotation path, thereby limiting an air flow to said ports from said air inlet for assisting a combustion process within the kiln, wherein the one end is closed by an end assembly fixed relative to the support structure, whereby the end assembly is maintained in close abutting relationship with the one end, the air inlet comprising an opening provided in the end assembly and a plenum chamber connected to the air source, the plenum chamber overlying the opening, the opening being positioned such that on rotation of the drum the ends of the passageways at the one end come into fluidic communication with the opening.

6. The kiln as claimed at claim 5, wherein the opening comprises at least in part an annular configuration that is concentric with the drum and is complementary to, at least in part, the rotation path of the passageways at the one end.

7. The kiln as claimed in claim 1, wherein said passageways are substantially equi-angularly located around the drum.

8. The kiln as claimed at claim 7, wherein the passageways are defined by channels located in the refractory material and wherein the channels are closed by the side wall.

9. The kiln as claimed at claim 7, wherein the passageways are formed within the refractory material between an inner and outer face thereof.

10. The kiln as claimed in claim 1, wherein each passageway communicates with the plurality of ports.

11. The kiln as claimed in claim 1, wherein the kiln further comprises a burner arranged to direct heat towards the inner face.

12. The kiln as claimed at claim 11, wherein an outlet of the burner is located such that it is directed onto the inner face at a lowermost portion of the drum.

13. The kiln as claimed in claim 1, wherein the interior of the drum is isolated from an exterior of the drum.

14. The kiln as claimed in claim 1, wherein the refractory material comprises inwardly projecting protrusions.

15. The kiln as claimed at claim 14, wherein the protrusions comprise a set of rib like formations.

16. The kiln as claimed at claim 15, wherein the rib-like formations comprise a helical configuration.

17. The kiln as claimed at claim 15, wherein the passageways are substantially parallel with the central axis of the drum.

18. The kiln as claimed at claim 15, wherein the passageways are configured to axially conform with the rib-like formations.

19. The kiln as claimed in claim 15, wherein the passageways are generally located in one to one relationship with the rib-like formations.

20. The kiln as claimed in claim 14, wherein the ports open into the interior of the drum at a trailing face of the protrusions.

21. The kiln as claimed at claim 20, wherein the ports open into the interior of the drum at a region proximal a base of the trailing face of the protrusions.

22. The kiln as claimed in claim 1, wherein the opening is disposed within the plate.

* * * * *